US007752846B2

(12) United States Patent
Boston et al.

(10) Patent No.: US 7,752,846 B2
(45) Date of Patent: Jul. 13, 2010

(54) COMBUSTION CHAMBER FOR A GAS TURBINE

(75) Inventors: Ian William Boston, Horgen (CH); Stefan Gross, Rottweil (DE); Jonas Hurter, Baden (CH); Thomas Kueenzi, Birsfelden (CH)

(73) Assignee: ALSTOM Technology Ltd, Baden (CH)

( * ) Notice: Subject to any disclaimer, the term of this patent is extended or adjusted under 35 U.S.C. 154(b) by 437 days.

(21) Appl. No.: 11/592,277

(22) Filed: Nov. 3, 2006

(65) Prior Publication Data

US 2008/0230997 A1 Sep. 25, 2008

Related U.S. Application Data

(63) Continuation of application No. PCT/EP2005/051807, filed on Apr. 22, 2005.

(30) Foreign Application Priority Data

May 5, 2004 (CH) ..... 00798/04

(51) Int. Cl.
*F02C 1/00* (2006.01)
*F02G 3/00* (2006.01)

(52) U.S. Cl. ..... 60/752

(58) Field of Classification Search ..... 60/752, 60/754, 760, 799, 800, 796, 798; 277/355
See application file for complete search history.

(56) References Cited

U.S. PATENT DOCUMENTS 5,323,604 A * 6/1994 Ekstedt et al. ..... 60/804
5,400,586 A * 3/1995 Bagepalli et al. ..... 60/800
5,944,320 A * 8/1999 Werner et al. ..... 277/355
6,186,508 B1 * 2/2001 Zajchowski et al. ..... 277/355
6,357,752 B1 3/2002 Lampes
6,471,213 B1 * 10/2002 Yuri et al. ..... 277/355

FOREIGN PATENT DOCUMENTS

| | | | |
|---|---|---|---|
| EP | 0 896 193 | A2 | 2/1999 |
| EP | 1 319 896 | A2 | 6/2003 |
| EP | 0 990 851 | B1 | 7/2003 |
| GB | 2 361 304 | A | 10/2001 |
| WO | 98/16764 | A1 | 4/1998 |
| WO | 02/088601 | A1 | 11/2002 |

OTHER PUBLICATIONS

International Search Report dated Aug. 18, 2005 (with English translation of category of cited documents).
Written Opinion of the International Searching Authority, Mar. 5, 2006.
Swiss Search Report dated Jul. 15, 2004 (with English translation of category of cited documents).

* cited by examiner

*Primary Examiner*—Michael Cuff
*Assistant Examiner*—Andrew Nguyen
(74) *Attorney, Agent, or Firm*—Buchanan Ingersoll & Rooney PC

(57) ABSTRACT

A combustion chamber for an industrial gas turbine has thermal protective elements which are installed along the inner circumference of its casing. The thermal protective elements are cooled by cooling air which is added to the fuel in the region in front of a front casing section after the cooling. A brush seal is installed between the front casing section and the thermal protective elements, where the brush seal is configured in segments. The combustion chamber can be sealed against leakages of cooling air in all operating states of the combustion chamber.

16 Claims, 4 Drawing Sheets

COMBUSTION CHAMBER FOR A GAS TURBINE

CROSS-REFERENCE TO RELATED PATENT APPLICATIONS

This application is based on and claims priority under 35 U.S.C. §119 to Swiss Application No. 00798/04, filed May 5, 2004 and is a continuation application under 35 U.S.C. §120 of International Application No. PCT/EP2005/051807, filed Apr. 22, 2005 designating the U.S., the entire contents of both of which are hereby incorporated by reference.

BACKGROUND

A combustion chamber is disclosed for a gas turbine with a thermal protective lining, as is a seal for the semi-static region between elements of the thermal protective lining. Combustion chambers of this type can be used in large gas turbines, such as stationary, industrial gas turbines.

The combustion chambers for gas turbines are typically lined with thermal protective elements which protect the combustion chamber casing from hot gas of the combustion chamber, and for this purpose, are fastened on supports in the combustion chamber casing, in the form of segments arranged in series along the circumference of the combustion chamber. The protective lining is cooled by cooling air which flows between the supports and the segments. The cooling air can be guided in the direction of the combustion chamber axis, and subsequently added to the fuel in the region of the combustion chamber inlet. Seals are installed at the combustion chamber inlet of the combustion chamber, between the thermal protective elements and the combustion chamber casing. They can prevent cooling air from reaching the combustion chamber between protective elements and casing and influencing the combustion process.

The thermal protective elements can be subjected to movements of varied magnitude and varied frequency.

Movements of lower frequency due to thermal expansions, which are also known as so-called "low cycle fatigue movements", can occur in the axial direction and also in the radial direction. They can be especially significant in large, stationary industrial gas turbines, since there the thermal expansions, on account of the large dimensions of the component parts, are in a large ratio to the precision with which the gas turbine and combustion chamber are manufactured. The thermally conditioned relative movements mean a challenge in the seal between the thermal protective elements and also in the region around the protective elements. Movements of higher frequency of the thermal protective elements can result from vibrations which can occur during general combustion chamber operation. The operation can induce vibrations of varied frequencies in the protective elements, which due to the natural frequencies of the protective elements can lead to increased vibrations of protective elements and supports. They are also known as so-called "high cycle fatigue movements", and are of smaller magnitude and of higher frequency in comparison to the thermally induced movements. They can especially reduce the reliable operating period of the protective elements.

The thermal protective elements, their supports, and also adjacent component parts are basically static. Since the interspaces between individual protective elements and also the spaces between the protective elements and adjacent component parts, however, are subjected to the aforementioned relatively large movements, the protective elements and the seals for the interspaces can be considered to be in a semi-static range.

There are various measures which are known for damping of vibrations in a combustion chamber. For example, the magnitudes of vibrations can be reduced by the amplitudes and frequencies of the vibrations being damped or interrupted. This, for example, can be realized by conscious control of the combustion process, or by acoustic damping elements in the combustion chamber which dissipate the energy of the oscillations.

EP 990 851 discloses a method for acoustic damping of vibrations inside combustion chambers by Helmholzt damping. There, a combination of Helmholtz resonators with a further damping medium, such as a plurality of plates with openings for a cooling flow, is disclosed.

U.S. Pat. No. 6,357,752 discloses the use of brush seals in the region between the end, in the flow direction, of a combustion chamber for a gas turbine and the first stator row of the gas turbine. It involves there a brush seal of double construction, wherein the pressure drops across the first seal and second seal in opposite directions. The disclosures of EP 990,851 and U.S. Pat. No. 6,357,752 are hereby incorporated by reference in their entireties.

SUMMARY

A combustion chamber is disclosed for a gas turbine, such as for large, stationary, industrial gas turbines. The combustion chamber, especially in the region of protective elements on the casing wall of the combustion chamber at the combustion chamber inlet, can be configured so that as far as possible no cooling air for cooling of the protective elements gets into the combustion chamber, which would interfere with the combustion process. This can be provided especially in the case of the basically static protective elements being in a semi-static range in that they are subjected to large thermal movements and also vibrations, and the sizes of the distances between the protective elements and the front casing being subjected to correspondingly large fluctuations.

An exemplary combustion chamber for a gas turbine comprises a combustion chamber casing and a front casing section. At the inner circumference of the wall of the combustion chamber casing, a plurality of thermal protective elements are installed in segmented fashion over the circumference of the combustion chamber, which protect the combustion chamber casing from the radiation of the combustion process. For cooling of the protective elements, a cooling air flow flows between the thermal protective elements and the combustion chamber casing wall and in the direction from the region of the combustion chamber outlet to the region of the combustion chamber inlet, wherein the cooling air finally reaches a cavity outside the front casing of the combustion chamber. A brush seal can be installed between the front casing section of the combustion chamber and the thermal protective elements, which extends beyond the circumference of the front casing section.

An exemplary combustion chamber has a brush seal which seals the cavity outside the front casing section, into which the cooling air flows, from the inner cavity of the combustion chamber. It can provide especially a uniform seal over the circumference of the combustion chamber, and a temporally uniform seal during the various operating states of the combustion chamber. It can prevent an uncontrolled penetration of cooling air into the combustion chamber and prevents influences on the combustion process which result from it. As a result, a temporally stable and also spatially uniform and reproducible combustion can be achieved by the combustion chamber. Thus, the brush seal provides a sealing effect even during large, thermally conditioned relative movements ("low cycle fatigue movement") of the component parts, since they inherently provide a large, elastic flexibility. This seal is able to prevent a cooling air leakage even during thermal movements of the type in which a protective element bends in the opposite direction, so instead of into the usual curvature in accordance with the shape of the combustion chamber casing wall it bends inwards in the opposite direction.

The combustion chamber can be especially advantageous in large, industrial gas turbines, since there the thermal movements are large, especially in comparison to the precision to which the component parts of the gas turbine are arranged with respect to each other.

The brush seal can provide a reliable seal even with high frequency oscillations ("high cycle fatigue movement") of the component parts which are in contact with the seal.

During high and low frequency oscillations of the thermal protective elements, the brush seal brings about a damping of the high and low frequency oscillations, in addition to its sealing function. On the one hand, this can be produced by friction damping by relative sliding movements of the combustion chamber casing and the protective elements. On the other hand, it can be produced by deformation or bending of the bristles on account of the pressure force which is exerted on the bristles during thermal movements. As a result, a type of spring action is produced. The damping of the oscillation can also be produced by a combination of friction damping and deformation of the bristles.

As a consequence, the oscillations are dissipated or even canceled out, a result of which the oscillation is reduced. This type of oscillation damping can be achieved for all oscillation frequencies which occur in all operating states of the combustion chamber. By the damping of the oscillations of the protective elements, on one hand the seal can be further improved, and on the other hand the period of operational use of the protective elements extended.

In a first exemplary embodiment, the brush seal is configured in segments which are arranged in series over the circumference of the combustion chamber, wherein each of the segments of the brush seal is in contact with at least two thermal protective elements in each case.

In a second exemplary embodiment, the brush seal is fastened in the front casing of the combustion chamber, and the bristles extend in the direction of the thermal protective elements. This can be advantageous when considering that the oscillations of the front casing are smaller than those of the protective elements. In corresponding situations, it is also realizable to fasten the brush seal to the protective elements.

In a further embodiment, the brush seal can be configured with the bristles being oriented at an angle to the radial direction to the longitudinal axis of the combustion chamber. In particular, the bristles can be oriented at an angle in the direction of the circumferential tangent. This also allows a sealing action in the varying radial gap between the combustion chamber front casing and thermal protective elements which encompass the front casing. The angle of orientation is arbitrary, however is preferably 45°±5°, or lesser or greater.

In an exemplary embodiment, brush seals are used which by pressing in are fastened in a frictional and positive locking manner in a slot with clamping effect. Such brush seals provide the advantage that they can be installed in a small space, and installed in component parts with a small arbitrary radius of curvature.

In a further variant, the surface with which the bristles of the brush seal are in contact is provided with a coating to protect against wear. This coating, for example of $Cr_3C_2$, provides an exceptionally smooth surface over which the bristles can slide without digging into the component part, as a result of which the wear of the bristles is much reduced. As a result, the coating brings about an increase in the friction damping and ensures a higher sealing action with longer service life of the bristles.

In a further embodiment, the bristles of the brush seal have a pretensioning in the axial direction, wherein in this case it means the direction of the combustion chamber casing. A pretensioning provides a good seal in the particular case of a small pressure drop across the seal. In an exemplary combustion chamber, the pressure drop is small in comparison with the pressure drop with other seals, such as with a brush seal on a turbine rotor.

DETAILED DESCRIPTION

Figure 1:
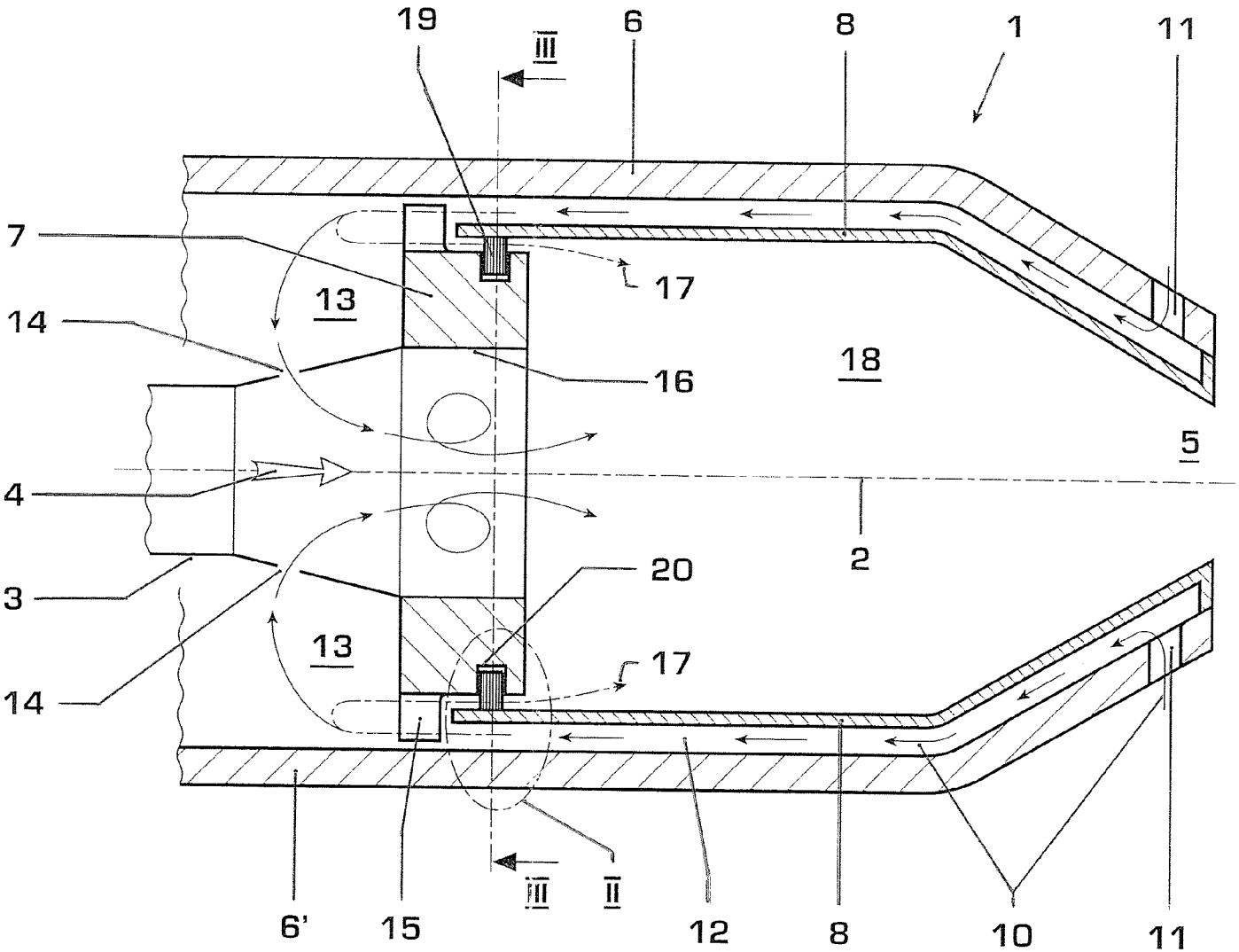
FIG. 1 shows a section through a segment of an exemplary annular combustion chamber for a gas turbine, and an arrangement of the combustion chamber casing, the front casing section and the thermal protective elements.

An exemplary combustion chamber 1 for a gas turbine in section along the longitudinal axis 2 of a burner 3 is shown in FIG. 1. The burner 3, through which fuel flows in the indicated direction 4, is schematically shown at the combustion chamber inlet. The combustion chamber 1 is enclosed by a circular-symmetrical combustion chamber casing 6 which extends in the longitudinal direction from the burner 3 as far as the combustion chamber outlet 5 to which is attached the first stator row of the gas turbine. The combustion chamber 1 has a front casing 7 with an opening in which the burner 3 is installed. The inner surface of the combustion chamber casing 6, 6' is lined with thermal protective elements 8 which are fastened on the casing wall 6, 6', for example by means of supports. In order to withstand the temperatures of the hot gas inside the combustion chamber, the thermal protective elements are cooled by a cooling air flow 10. The cooling air, which, for example is extracted from the compressor for the gas turbine, is guided through openings 11 in the combustion chamber casing 6, 6' into the interspace 12 between the combustion chamber casing wall 6, 6' and the thermal protective elements 8, and is guided in the axial direction in the opposite direction of flow of the fuel into a cavity 13 outside the front casing 7 of the combustion chamber. There, it is fed through openings 14 in the casing of the burner 3 to the fuel flow.

The front casing 7 of the combustion chamber 1 is fastened on the combustion chamber casing 6, 6' by struts 15. It has an opening 16 in which the burner 3 is installed. Areas of a possible leakage flow 17 of cooling air into the cavity 18 of the combustion chamber are located between adjacent struts 15, and between the front casing 7 and the oppositely disposed thermal protective element 8, in each case.

A seal 19 is installed in the region between the front casing 7 and protective elements 8. It can be fastened in a slot 20 let in in the front casing 7, and extends up to the surface of the thermal protective element 8. The thermal protective elements 8 are fastened and fixed at a point, for example in the region of the first turbine stator row, from which the thermal movements emanate in the axial and radial direction.

Figure 2:
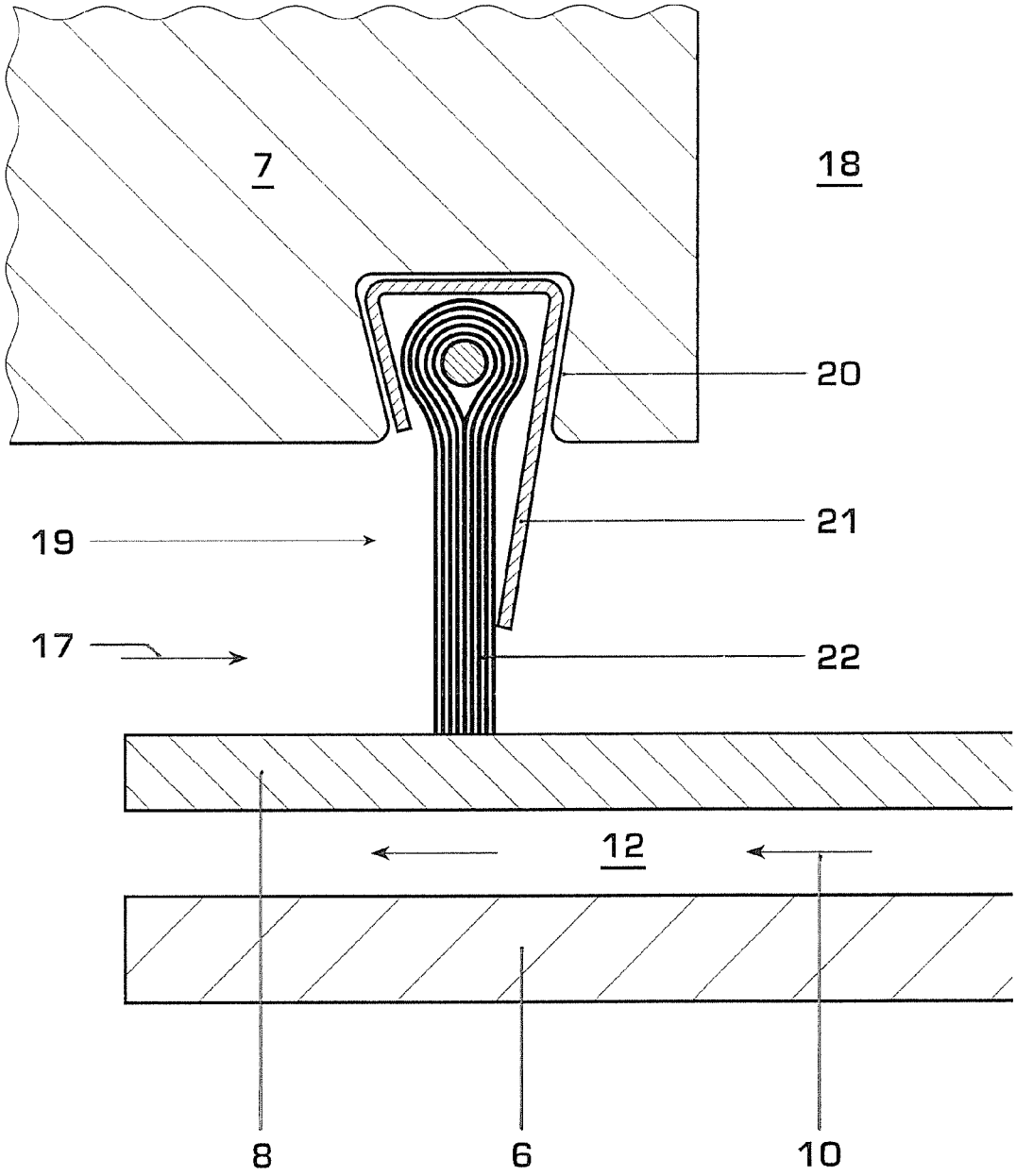
FIG. 2 shows the detail II according to FIG. 1, and an exemplary seal between the front casing and thermal protective element against a leakage flow into the combustion chamber.

FIG. 2 shows a detailed view of the region II in FIG. 1 in which are shown a part of the front casing 7 and a part of the oppositely disposed thermal protective element 8 and the combustion chamber casing wall 6. The cooling air flow 10, which flows through the interspace 12 between protective element and casing wall, is shown in turn between the casing wall 6 and the protective element 8. A slot 20, which has an undercut, is located on the front casing 7 on the side facing the combustion chamber casing. A brush seal 19 is installed in the slot 20. A brush seal can be used which was manufactured by a pressing in method by means of a clamp 21. The bristles 22 extend in the indicated plane radially (with regard to the axis 2) towards the protective element.

Figure 3:
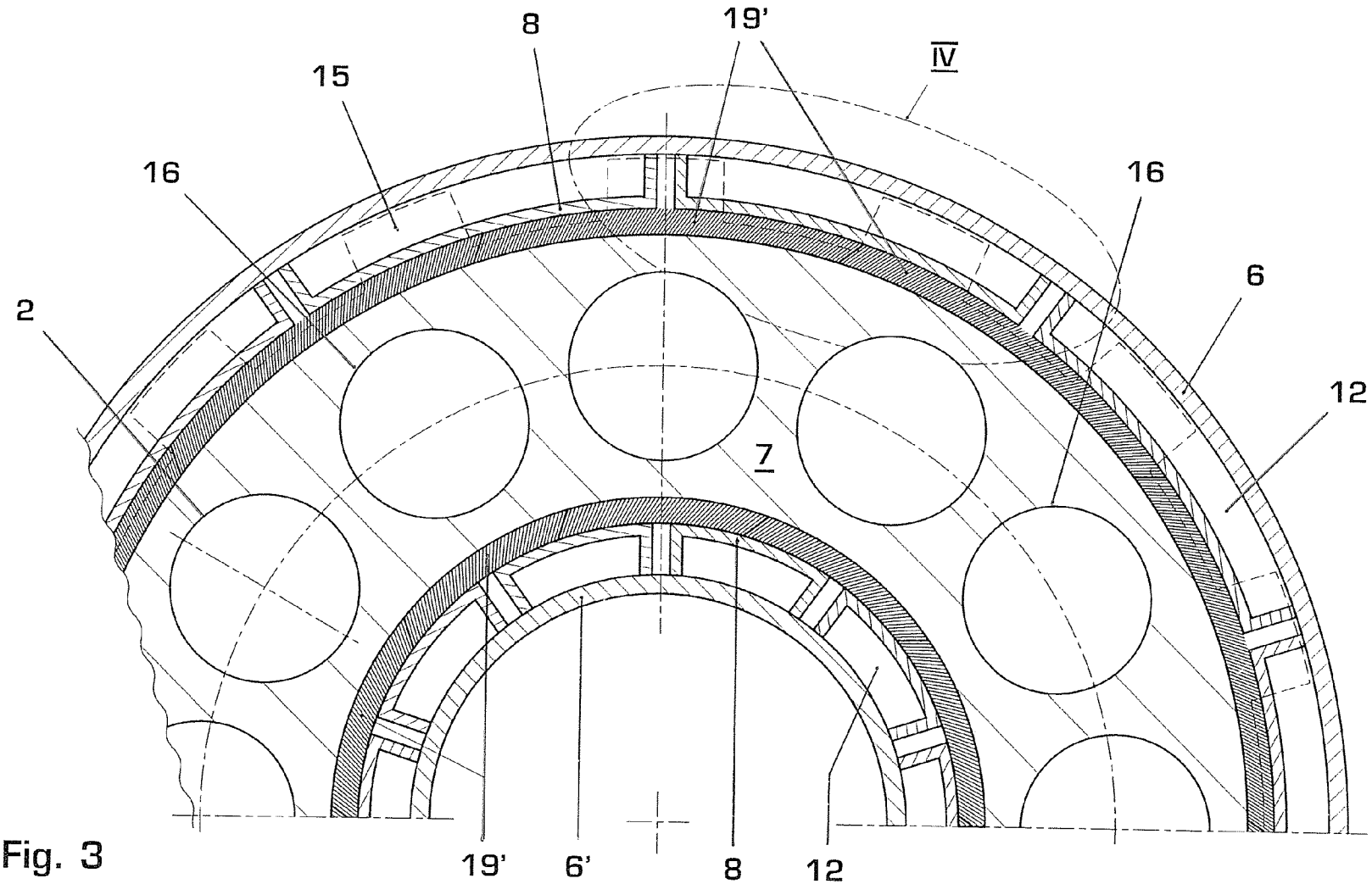
FIG. 3 shows the cross section which is indicated in FIG. 1 by III-III, and an exemplary segment-like arrangement of the thermal protective elements and the brush seal.

FIG. 3 shows the upper half of the annular combustion chamber in a section through the front casing 7 according to III-III in FIG. 1. There are several openings 16 shown for the burners, which are located along the circumference of the annular combustion chamber. The struts 15 along the circumference of the front casing 7, by which it is fastened on the combustion chamber casing 6, 6', are indicated by broken lines. The thermal protective elements 8 are fastened on the inner wall of the combustion chamber casing 6, both on the outer casing wall 6 and also on the inner casing wall 6' of the ring. They extend over a segment of the whole circumference in each case. Seals, which prevent hot gas getting into the combustion chamber casing 6, are attached between the individual protective elements 8. A cavity 12, through which flows the cooling air flow, is located between combustion chamber casing wall 6 and protective elements 8. The seal 19 can extend from the front casing 7 to the protective elements 8, wherein the bristles are orientated at an angle to the radial direction. The seal 19 is installed in segmented fashion. As a result, a single sealing segment 19' is in contact with at least two adjacent thermal protective elements 8. The transition from one brush seal element 19' to the next brush seal element 19', is almost seamless as a consequence, and can be located approximately at the height of the middle of a thermal protective element 8. The transitions can basically be positioned at any point with regard to the protective elements, including at points between two adjacent protective elements.

Figure 4:
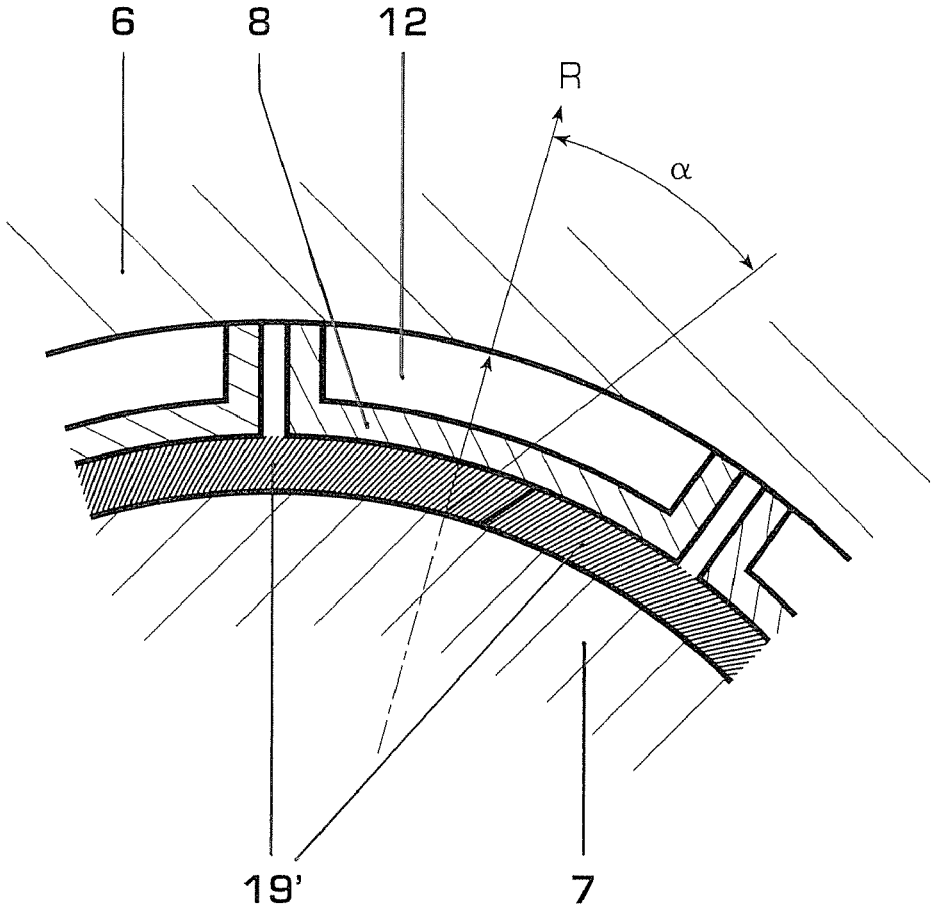
FIG. 4 shows an exemplary brush seal according to detail IV with reference to FIG. 3, and its arrangement along the circumference of the annular combustion chamber.

FIG. 4 shows a further detail according to IV in FIG. 3. The detail shows the orientation of the bristles of the brush seal 19 with regard to the radial direction of the combustion chamber. The bristles are inclined from the radial in the direction of the circumferential tangent by an angle $\alpha$ in any range, for example, in a range of 40-50°.

An inclination of the bristles away from the radial and towards the circumferential tangent results in the interface being reliably sealed, and uniformly sealed over the circumference, even with large fluctuations of the distance between the front casing circumference 7 and the thermal protective element 8. As a result of this, cooling air does not reach the interior of the combustion chamber during all operating states of the gas turbine and the burner. In any event, some cooling air gets into the combustion chamber, wherein, however, this occurs evenly over the circumference of the front casing, which still ensures a controlled operation of the combustion chamber.

Figure 5:
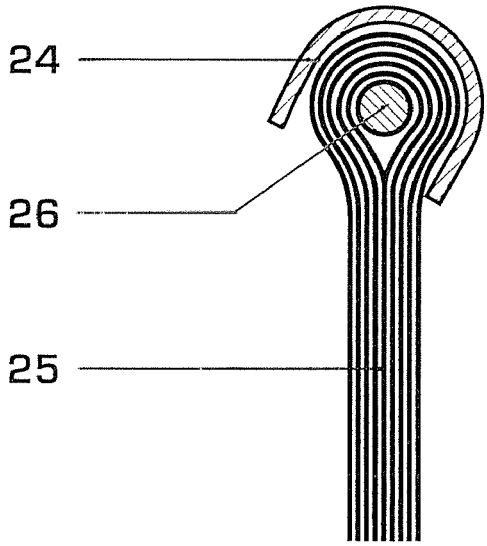
FIG. 5 shows an exemplary brush seal for pressing in with axial pretensioning, for use in the combustion chamber.

In a further exemplary embodiment of the combustion chamber, the brush seal is designed specially for use in the case of small pressure drops. The brush seal in this case is designed especially with a pretensioning of the bristles in the direction opposite the leakage flow. The pretensioning is produced during the manufacture of the seal by placing the clamp 24 over the part of the bristles 25 which is wound around a round rod 26, wherein the ends of the clamp 24 are inclined at a predetermined angle, and not parallel, to the run of the bristles 25, as shown in FIG. 5. By the pressing into the slot 20 of the front casing section 7, the bristles are again set straight, as shown in FIG. 2. As a result, the bristles maintain a pretensioning. The greater the desired pretensioning is, the larger the angle is selected to be.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A combustion chamber for a gas turbine, wherein the combustion chamber comprises:

a burner;

a casing;

a front casing section in which the burner is installed;

thermal protective elements provided in individual separated segments along an inner circumference of the casing and forming a cooling air passage between the casing and the thermal protective elements, the cooling air passage in fluid communication with an opening for a source of cooling air;

a brush seal extending between the front casing section and the thermal protective elements, which extends beyond the circumference of the front casing section, the brush seal placed to block cooling air from the cooling air passage from entering the combustion chamber; and wherein the brush seal is shaped in individual separated segments, and each segment of the brush seal is in contact with at least two segments of the thermal protective elements.

2. The combustion chamber as claimed in claim 1, wherein the brush seal is fastened on the front casing section, and the bristles of the brush seal extend from the front casing section to the thermal protective elements.

3. The combustion chamber as claimed in claim 1, wherein the bristles of the brush seal extend from their base at an angle other than a right angle, to a radial of the combustion chamber and to the circumferential tangent of the combustion chamber.

4. The combustion chamber as claimed in claim 3, wherein the angle to the radial lies within a range of 40-50°.

5. The combustion chamber as claimed in claim 1, wherein the surface with which the ends of the bristles of the brush seal are in contact has a coating.

6. The combustion chamber as claimed in claim 5, wherein the coating is a wear-resistant coating.

7. The combustion chamber as claimed in claim 1, wherein the bristles of the brush seal are pretensioned.

8. The combustion chamber as claimed in claim 7, wherein for the brush seal, a brush seal is used which is fastened on the front casing section by means of pressing in.

9. The combustion chamber as claimed in claim 1, in combination with an industrial, stationary gas turbine.

10. The combustion chamber as claimed in claim 1, wherein a slot is located along the circumference of the front casing section, and for the brush seal, a brush seal is used which by pressing in is fastenable in a frictional and positive locking manner in the slot with clamping effect.

11. The combustion chamber as claimed in claim 3, wherein a slot is located along the circumference of the front casing section, and for the brush seal, a brush seal is used which by pressing in is fastenable in a frictional and positive locking manner in the slot with clamping effect.

12. The combustion chamber as claimed in claim 3, wherein the surface with which the ends of the bristles of the brush seal are in contact has a coating.

13. The combustion chamber as claimed in claim 11, wherein the surface with which the ends of the bristles of the brush seal are in contact has a coating.

14. The combustion chamber as claimed in claim 1, wherein the cooling air is extracted from a compressor for the gas turbine.

15. The combustion chamber as claimed in claim 1, wherein a direction of cooling air flow in the cooling air passage is substantially opposite a direction of fuel flow into the burner.

16. The combustion chamber as claimed in claim 1, wherein the cooling air passage is arranged in the burner to supply cooling air to fuel supplied to the burner.

* * * * *